US011542074B1

(12) United States Patent
Lee et al.

(10) Patent No.: US 11,542,074 B1
(45) Date of Patent: Jan. 3, 2023

(54) FLIP STRAW CUP ASSEMBLY

(71) Applicant: Munchkin, Inc., Van Nuys, CA (US)

(72) Inventors: Agnes Yena Lee, Los Angeles, CA (US); Sung Yun Chan, Pasadena, CA (US); Kevin Douglas Johnson, Tarzana, CA (US); Dewey Yu, San Jose, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 17/367,159

(22) Filed: Jul. 2, 2021

(51) Int. Cl.
*A47G 21/18* (2006.01)
*B65D 47/08* (2006.01)
*A47G 19/22* (2006.01)

(52) U.S. Cl.
CPC ..... *B65D 47/0885* (2013.01); *A47G 19/2205* (2013.01); *A47G 21/186* (2013.01); *B65D 2251/20* (2013.01)

(58) Field of Classification Search
CPC .. A47G 21/18; A47G 21/186; A47G 19/2272; A47G 19/2266; A47G 19/2205; B65D 77/283; B65D 2543/00046; B65D 47/0885; F16L 59/022
USPC ..... 215/388; 220/705, 707
See application file for complete search history.

(56) References Cited

U.S. PATENT DOCUMENTS 2,084,673 A 6/1937 Dieffenbach
2,483,095 A 9/1949 Ingles
2,782,805 A 2/1957 Leadbetter
3,380,481 A 4/1968 Kraus
3,517,702 A 6/1970 Mueller et al.
4,535,197 A 8/1985 Butler
4,735,329 A * 4/1988 Le ..... B65D 47/286 215/229
4,865,890 A 9/1989 Erlichman
4,944,976 A 7/1990 Plummer
5,505,230 A 4/1996 Bartholomew
6,247,500 B1 6/2001 McMahon
8,312,875 B2 11/2012 Frater
8,376,165 B2 * 2/2013 Chiang ..... B65D 51/1644 220/360
8,622,262 B2 1/2014 Van Art
8,910,883 B2 12/2014 Mattheus
(Continued)

FOREIGN PATENT DOCUMENTS

CN 201002846 Y 1/2008
CN 104188337 B 11/2015
(Continued)

OTHER PUBLICATIONS https://www.kickstarter.com/projects/simplykleanfamily/patent-pending-resealable-and-reusable-silicone-straw, 13 Pages, retrieved Jun. 29, 2021.

(Continued)

*Primary Examiner* — King M Chu
(74) *Attorney, Agent, or Firm* — Robert Z. Evora, Esq.

(57) ABSTRACT

A flip straw cup assembly having a container body, a lid that may be detachable and a straw assembly. The lid Includes a flip straw that is biased towards an extended position and retractable into a recess and securable by a flip lock. The straw assembly includes a straw body, a cap and a resealable seam extending the longitudinal length of the straw body that is adapted to open the straw body for cleaning.

18 Claims, 18 Drawing Sheets

(56) References Cited

U.S. PATENT DOCUMENTS

| | | | | |
|---|---|---|---|---|
| 2005/0029271 | A1* | 2/2005 | McDonough | A47G 19/2266 220/705 |
| 2012/0280056 | A1 | 11/2012 | Schrimmer et al. | |
| 2014/0076604 | A1 | 3/2014 | Frye | |
| 2018/0160831 | A1 | 6/2018 | Yoo | |
| 2020/0069094 | A1 | 3/2020 | Tsai | |
| 2020/0128986 | A1 | 4/2020 | Tran et al. | |
| 2020/0146482 | A1 | 5/2020 | Watkins et al. | |
| 2020/0163477 | A1* | 5/2020 | Fung | A47G 21/18 |
| 2020/0229627 | A1 | 7/2020 | Wei | |
| 2020/0408234 | A1 | 12/2020 | Tran et al. | |

FOREIGN PATENT DOCUMENTS

| | | | |
|---|---|---|---|
| CN | 209915627 | U | 1/2020 |
| DE | 102011104166 | B4 | 11/2012 |
| EM | 0058399820001 | S | 12/2018 |
| EM | 0070079680001 | S | 10/2019 |
| JP | 3223766 | U | 10/2019 |
| KR | 1020160146533 | A | 12/2016 |
| KR | 1020180001331 | A | 1/2018 |
| KR | 102089172 | B1 | 3/2020 |
| TW | 201542422 | A | 11/2015 |
| WO | 2020034037 | A1 | 2/2020 |
| WO | 2020044132 | A1 | 3/2020 |
| WO | 2020053905 | A1 | 3/2020 |
| WO | 2020054988 | A1 | 3/2020 |
| WO | 2020065137 | A1 | 4/2020 |
| WO | 2020067147 | A1 | 4/2020 |

OTHER PUBLICATIONS https://www.kickstarter.com/projects/wondersip/wondersip-one-click-open-easy-to-clean-reusable-straw, 24 Pages, retrieved Jun. 29, 2021.

https://www.amazon.com/Rain-Straw-Reusable-Drinking-Cleaning/dp/B084GFLL2X/ref=sr_1_11?dchild=1&keywords=Silicone+straw+opens&qid=1585333888&sr=8-11,9 Pages, retrieved Jun. 29, 2021.

https://www.amazon.com/Snapstraw-Reusable-Silicone-Straw-Collapsible/dp/B07S4LMJG2/ref=sr_1_2?dchild=1&keywords=Silicone+straw+opens&qid=1585335668&sr=8-2, 10 Pages, retrieved Jun. 29, 2021.

https://reyousables.eco/products/hip-squeaky-clean-sillicon-straws, 4 pages, retrieved Jul. 2, 2021.

* cited by examiner

FLIP STRAW CUP ASSEMBLY

TECHNICAL FIELD

The subject disclosure relates generally to a cup assembly having a container body, a lid and a straw assembly adapted for easy cleaning by a user.

BACKGROUND

There are numerous cup assemblies on the market adapted for use with small children. These cups are often formed of a resilient material and may include features that make it easier for children to drink from the vessel, such as attached drinking straws, sealed lids with spouts, and the like. Cups that are designed with child users in mind also generally have features to prevent or guard against spills and accidental leaks. Additionally, parents are constantly multi-tasking and transporting small children to different locations and need drinking solutions that are portable, easy to secure and easy to use. Many of these cups are touted as easy to clean, however, repeated use of these cups may lead to the accumulation of mold, mildew, or other undesirable microorganisms such as bacteria and viruses. Straws, in particular, are notoriously difficult to clean and the user may never actually clean the interior surface of the straw.

Thus, there is a need for a cup assembly which is portable, easy to use, easy to clean and has a built-in design that promotes independent and safe use by a child or adult user.

SUMMARY

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

While various aspects, features, or advantages of the subject disclosure are illustrated in reference to cup assemblies, such aspects and features also can be exploited in various other drinking vessels or containers.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

In one exemplary embodiment, the present subject disclosure is a flip straw cup assembly. The cup assembly includes a container body, a lid having an extendable flip straw and a straw assembly. The straw assembly includes a straw body and a cap attached to an upper end of the straw body by a hinge. A seam extends the longitudinal length of the straw body and may be sealed closed for drinking or opened for cleaning an interior surface of the straw assembly.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
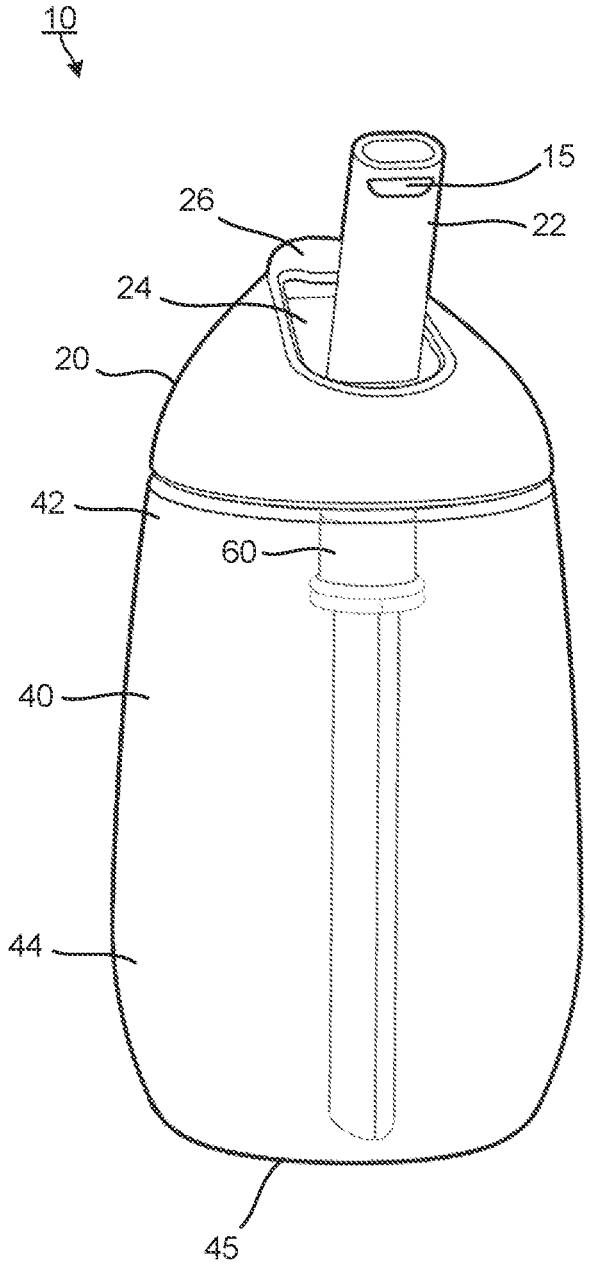
FIG. 1 is a front perspective view of a cup assembly, according to an exemplary embodiment of the present subject disclosure.

Particular embodiments of a cup assembly will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Figure 4:
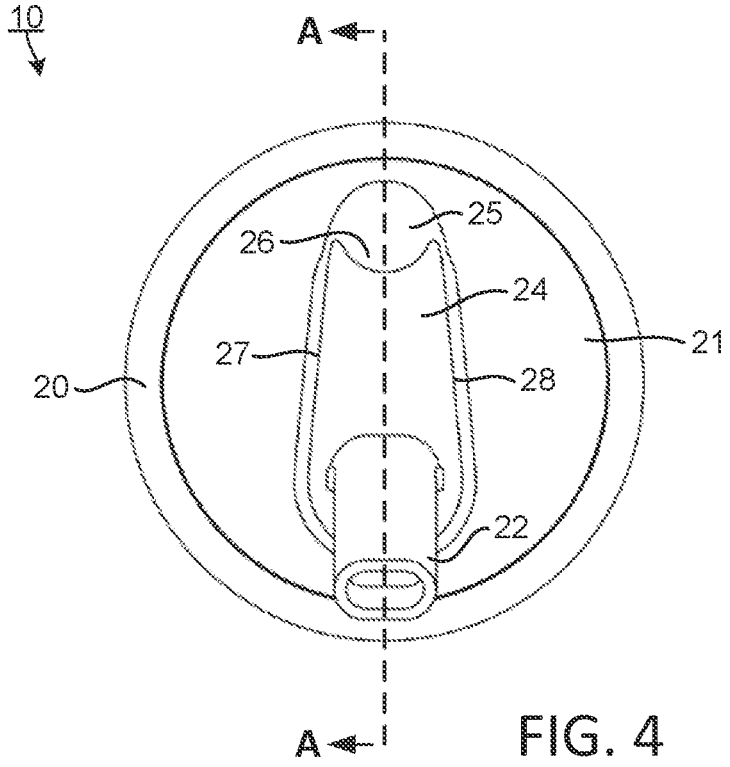
FIG. 4 is a top view of cup assembly, according to an exemplary embodiment of the present subject disclosure.
Figure 5:
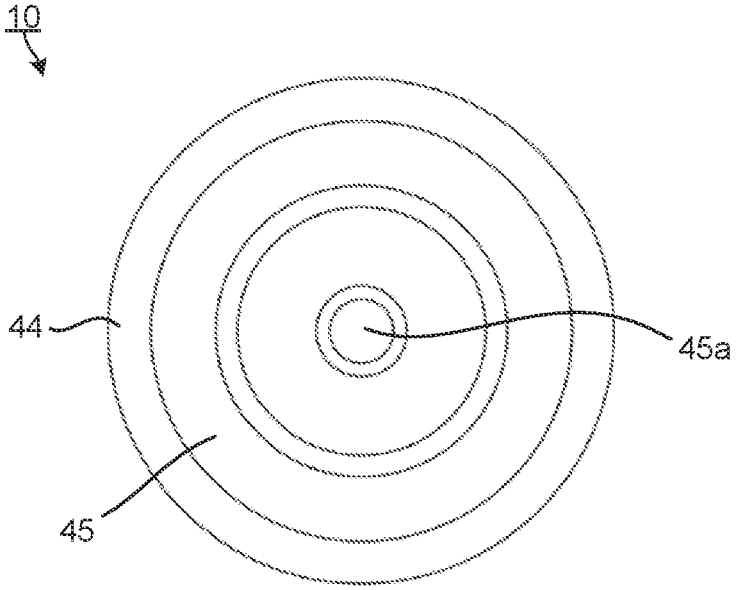
FIG. 5 is a bottom view of cup assembly, according to an exemplary embodiment of the present subject disclosure.
Figure 7A:
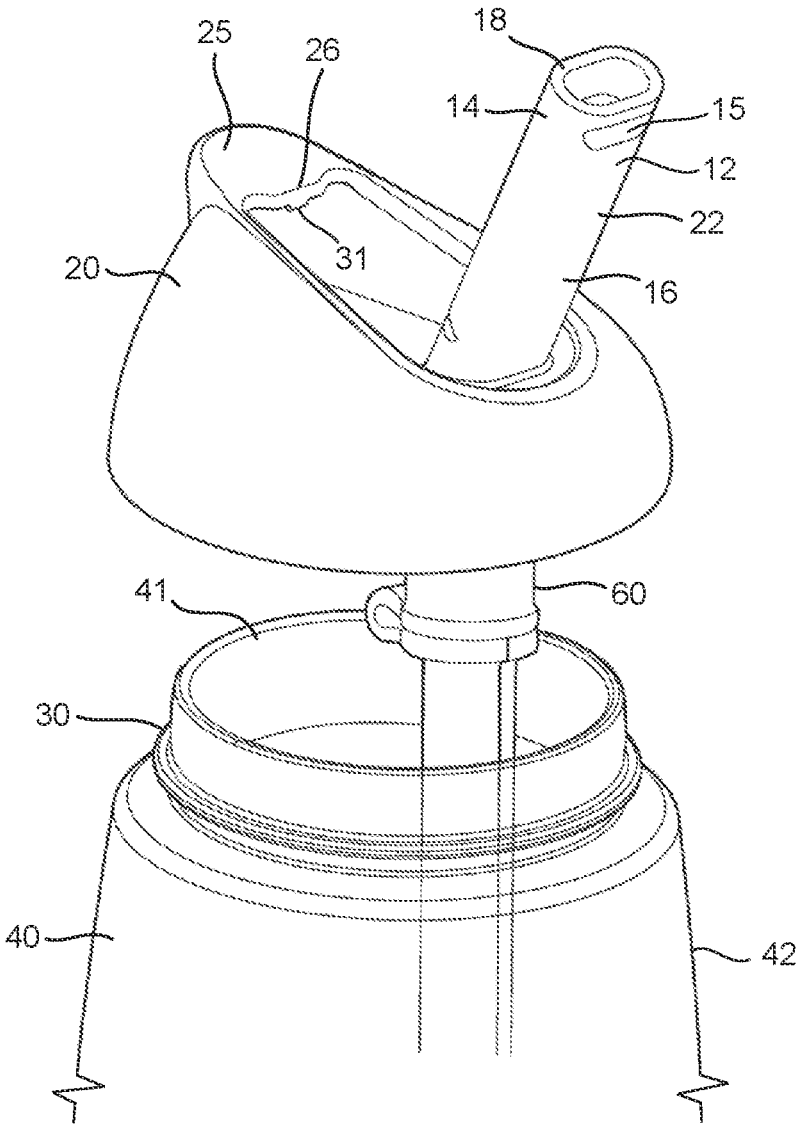
FIG. 7A is a close-up front perspective view of a lid shown detached from a container body of a cup assembly, according to an exemplary embodiment of the present subject disclosure.
Figure 7B:
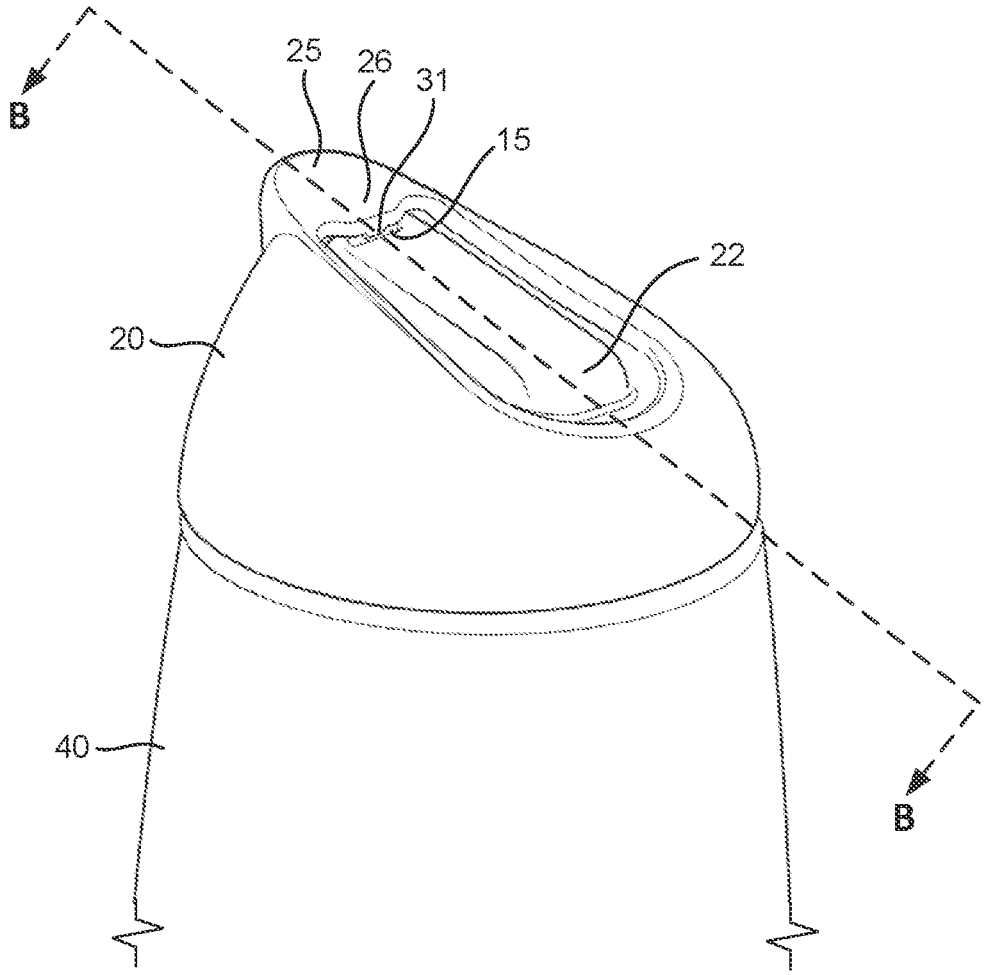
FIG. 7B is a close-up front perspective view of a lid attached to a container body of a cup assembly with a flip straw in a closed position, according to an exemplary embodiment of the present subject disclosure.
Figure 9:
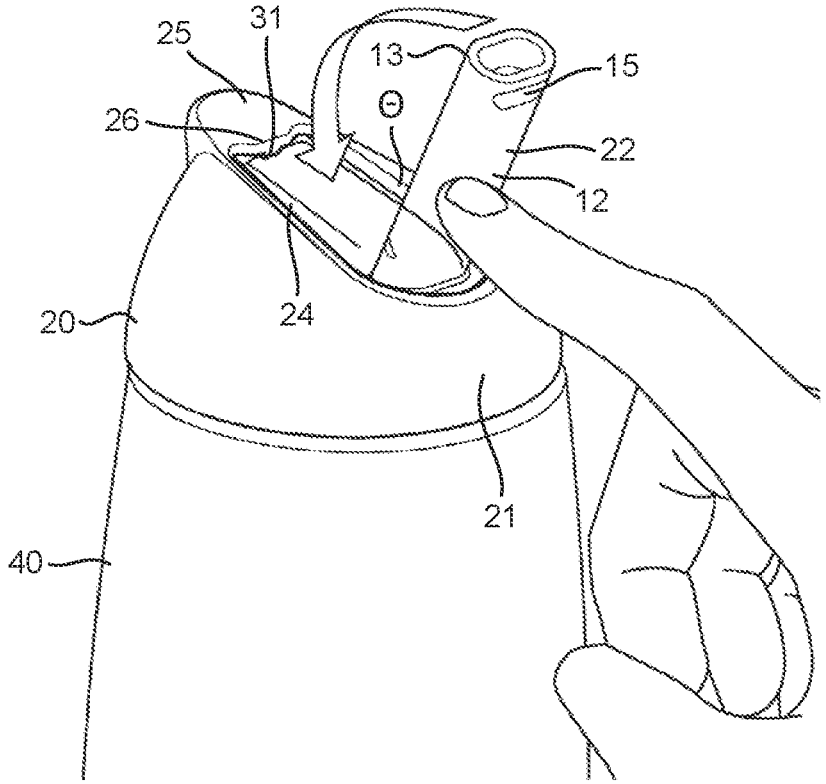
FIG. 9 is a front perspective view of the cup assembly in use, according to an exemplary embodiment of the present subject disclosure.
Figure 10:
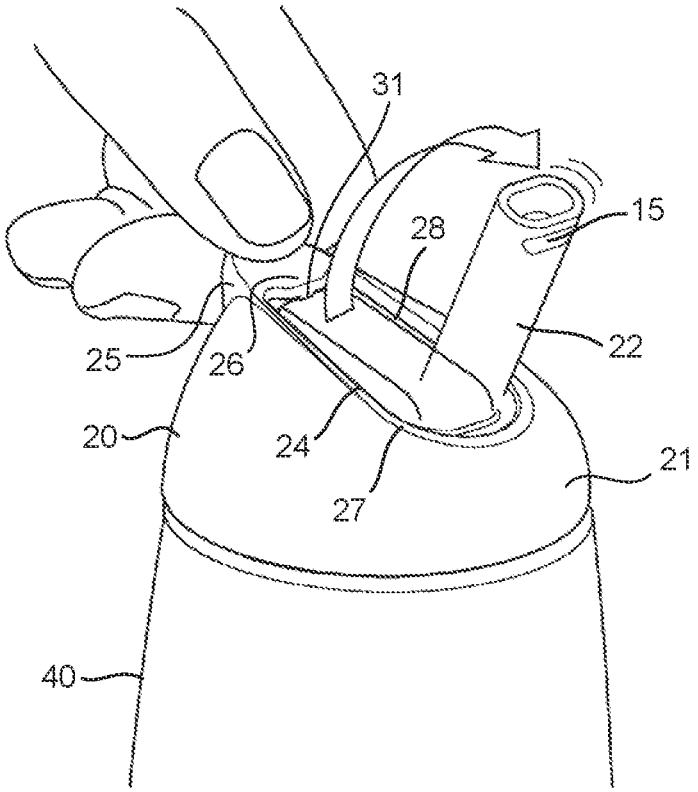
FIG. 10 is a front perspective view of the cup assembly in use, according to an exemplary embodiment of the present subject disclosure.

FIG. 1 is a front view of a cup assembly 10. The cup assembly 10 includes a container body 40, a lid 20 and a straw assembly 60 (FIGS. 4-5). The container body 40 includes an upper portion 42, a lower portion 44 and a bottom 45. The lid 20 includes a flip straw 22, a recess 24 and a flip lock 26. During use, the flip straw 22 is maintained and biased towards an extended position. During storage, travel or whenever a user desires not to drink from the cup assembly 10, the flip straw 22 may be retracted into the recess 24 and retained by the flip lock 26 in a locked position (FIG. 7B). When the user desires to drink from the flip straw 22, a trigger 25 disposed on, or as an integral part of, the flip lock 26 may be actuated, which then releases the flip straw 22 back to the extended position (FIGS. 9-10).

Figure 2:
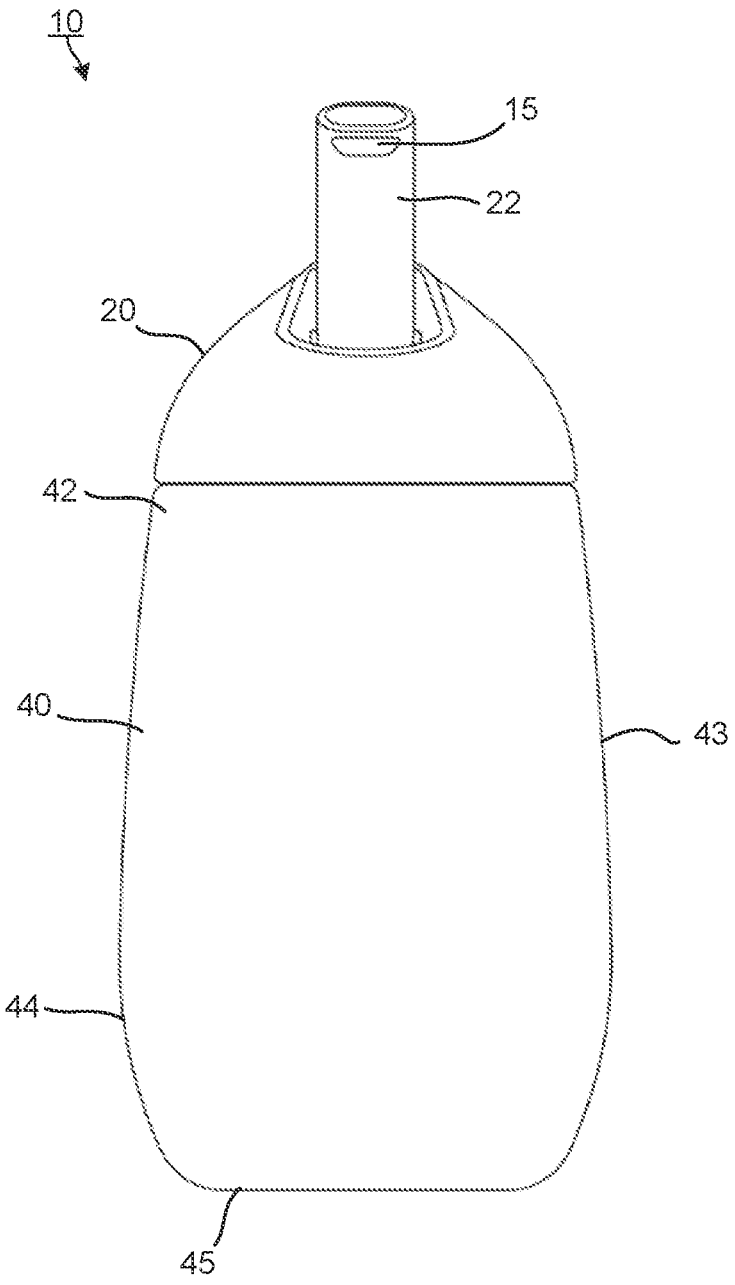
FIG. 2 is a front view of cup assembly, according to an exemplary embodiment of the present subject disclosure.
Figure 3:
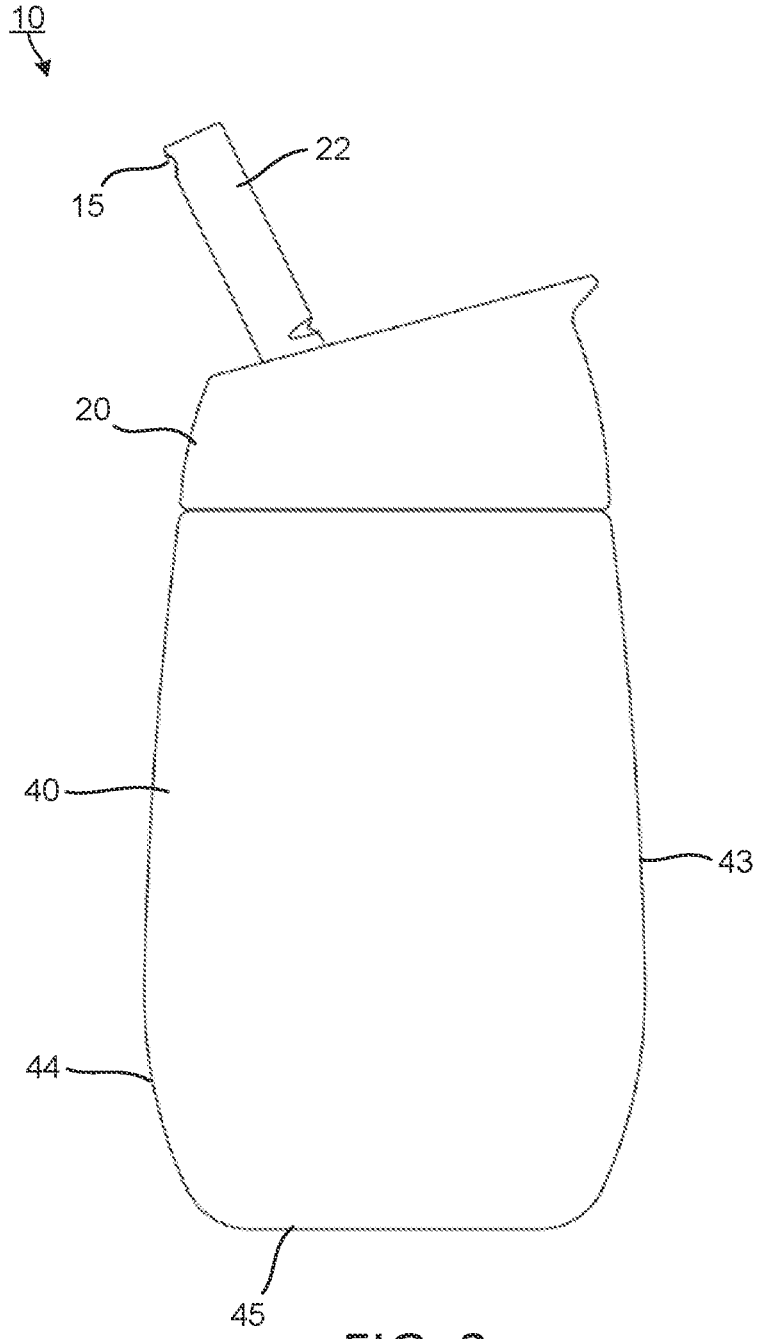
FIG. 3 is a side view of cup assembly, according to an exemplary embodiment of the present subject disclosure.

As shown in FIGS. 2-3, the container body 40 may be substantially cylindrical, however, the container body 40 may be any shape as long as it functions to receive a fluid for consumption as described herein. The lower portion 44 of the container body 40 may have a larger diameter across than the upper portion 42. The lower portion 44 of the container body 40 may be integrally attached to the bottom 45 and may be integrally attached to, or detachable from the upper portion 42. Alternatively, the bottom 45 may be detachable from the lower portion 44. The upper portion 42 of the container body 40 may be adapted to attach to the lid 20 through a lid attachment 30 (FIGS. 6-7), which will be described in further detail below. The container body 40 may have an outer surface 43. The outer surface 43 may be textured to facilitate a better grip for the user, The outer surface 43 may display a design, pattern, brand identifier, image or other indicia that may entertain, inform or please the user.

The container body 40, lid 20 or straw assembly 60 may be comprised of silicone, glass, ceramics, food grade materials, copolyesters such as Tritan, various thermosets or thermoplastics, polypropylene, polystyrene, polyethylene (PE), low-density polyethylene (LDPE), high-density polyethylene (HDPE), polyethylene terephthalate (PET), linear low-density polyethylene (LLDPE), polycarbonate, an ethylene vinyl alcohol (EVOH) copolymer, or may be formed completely or partially of one or more biopolymers, such as starch, cellulose derivatives, natural rubbers, polyimides, bio-monomers (polyimides, polybutylene succinate (PBS), Polyhydroxyalkanoates (PHAs), Poly(3-hydroxybutyrate-co-3hydroxyvalerate) (PHBV), bio-based PE, bio-based polyethylene terephthalate (Bio-PET), polylactic acid (PLA), and the like according to this subject disclosure. Using biodegradable plastics is advantageous in that they maintain their mechanical strength during practical use but break down into low-weight compounds and non-toxic byproducts at the end of their lifecycle. Such materials can be obtained through chemical synthesis, fermentation by microorganisms, and/or from chemically modified natural products.

The cup assembly 10 may include a bio-assimilator compound. One example of a bio-assimilator compound may be ECLIPSE™. Traditional plastic materials like PE may be difficult to degrade in the environment. A bio-assimilator is a compound that degrades plastic to a molecular weight that can be consumed by living organisms. This is a final and conclusive stage of plastic biodegradation that leaves behind no microplastic remnants. The addition of a bio-assimilator can be tailored to ensure a useful-life performance before degrading according to a set timetable. For example, a bio-assimilator may be added with a simple inclusion rate between 0.01-2% concentration (w/w=mass of solute/mass of solution×100) in the masterbatch or at any time during the manufacturing process, Additionally, a bio-assimilator may comprise between 0.01-10% concentration of the plastic formulation used to manufacture the cup assembly 10. The cup assembly 10 may be adapted to degrade between 1 and 60 months after the predetermined useful-life time frame. In one embodiment the cup assembly 10 may be adapted to degrade between 18-24 months. In another embodiment the cup assembly 10 may be adapted to degrade in approximately 36 months.

The cup assembly 10 may include the bio-assimilator to facilitate anaerobic biodegradation. The anaerobic degradation of the cup assembly 10 may meet or exceed the standards described in ASTM D.5511-02, ASTM D.5526-94 and ISO 15985 and ISO 14853. The bio-assimilator may be made from bio-sourced or artificial materials and may be included in standard or customized masterbatch formulations incorporated in the production process. The bio-assimilator may include manganese stearate in its formulation as a transition metal that serves as a catalyst to trigger the free-radical process within a polymer. Manganese stearate, or a similar catalyst, may be added at up to 4% to masterbatches of the Bio-assimilation additive, which may then be incorporated into plastic masterbatches at levels up to 1%. Alternatively, Manganese stearate may be added at up to 10% to masterbatches of the Bio-assimilation additive, which may then be incorporated into plastic masterbatches at levels between 0.01-3.0% The present invention is not limited in this regard, as other materials or combination of material, may be substituted without departing from the broader aspects of the present invention.

Figure 11:
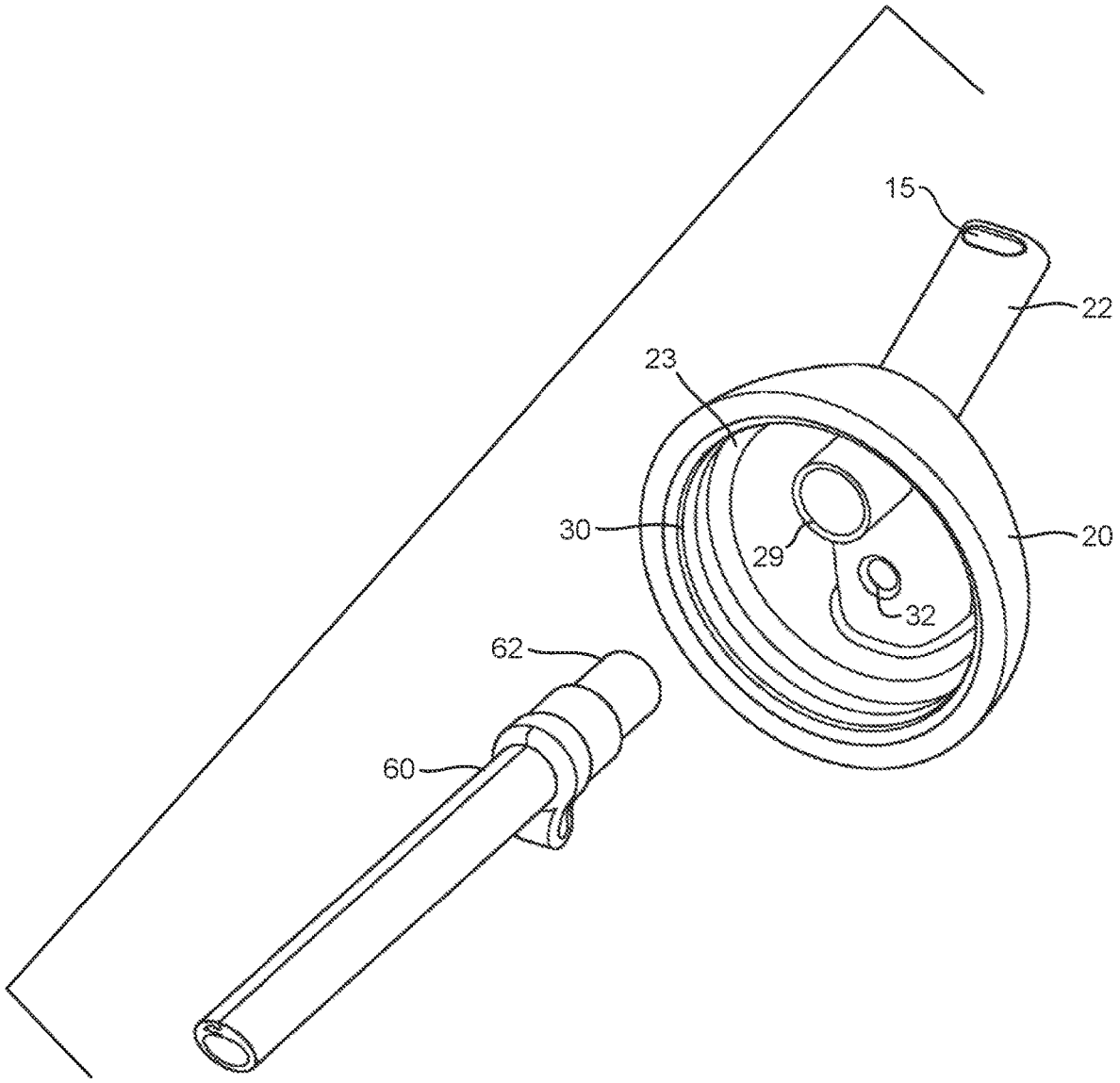
FIG. 11 is an exploded bottom view of a straw and a lid, according to an exemplary embodiment of the present subject disclosure.

FIG. 4 is a top view of the cup assembly 10 that shows various features of the lid 20. The lid 20 may include an upper surface 21 and a bottom surface 23 (FIG. 11). The upper surface 21 of the lid 20 may be curved and have a continuous surface area around the recess 24 that may be disposed in the center of the lid 20. The upper surface 21 may have a convex curvature, while the bottom surface 23 may have a concave curvature. Alternatively, the respective curvatures of the upper and bottom surfaces 21, 23 may be reversed such that the upper surface 21 has a concave curvature and the bottom surface 23 has a convex curvature.

The recess 24 may extend substantially the length of the diameter of the lid 20 and may be large enough to receive the flip straw 22 therein. As shown in FIG. 7B, the flip straw 22 may fit flush within the recess 24 such that the upper surface 21 of the lid 20 is smooth and continuous when the flip straw 22 is closed and contained in the recess 24. When the flip straw 22 is stored in the recess 24, the cup assembly 10 may be designed not to leak even when in an inverted or upside-down position. In the closed position (FIG. 8B), the flip straw is bent and pinched such that the liquid in the cup assembly 10 is unable to escape from therein. The flip lock 26 may be adapted to hold the flip straw 22 in the retracted or closed position and may be disposed at one end of the recess 24, or the flip lock 26 may be integrated along either a left sidewall 27 and/or a right sidewall 28 of the recess 24.

The trigger 25 may be disposed on the flip lock 26 and adapted to release the flip straw 22 from within the recess 24 and into an open and extended position when actuated by the user. The trigger 25 is actuated when the user applies a downward force to the trigger 25 thereby stretching the flip lock 26 out of the ledge 15 and thereby releasing the flip straw 22 from the captivated, locked position. The structure of the flip lock 26 will be described in greater detail below.

Figure 8A:
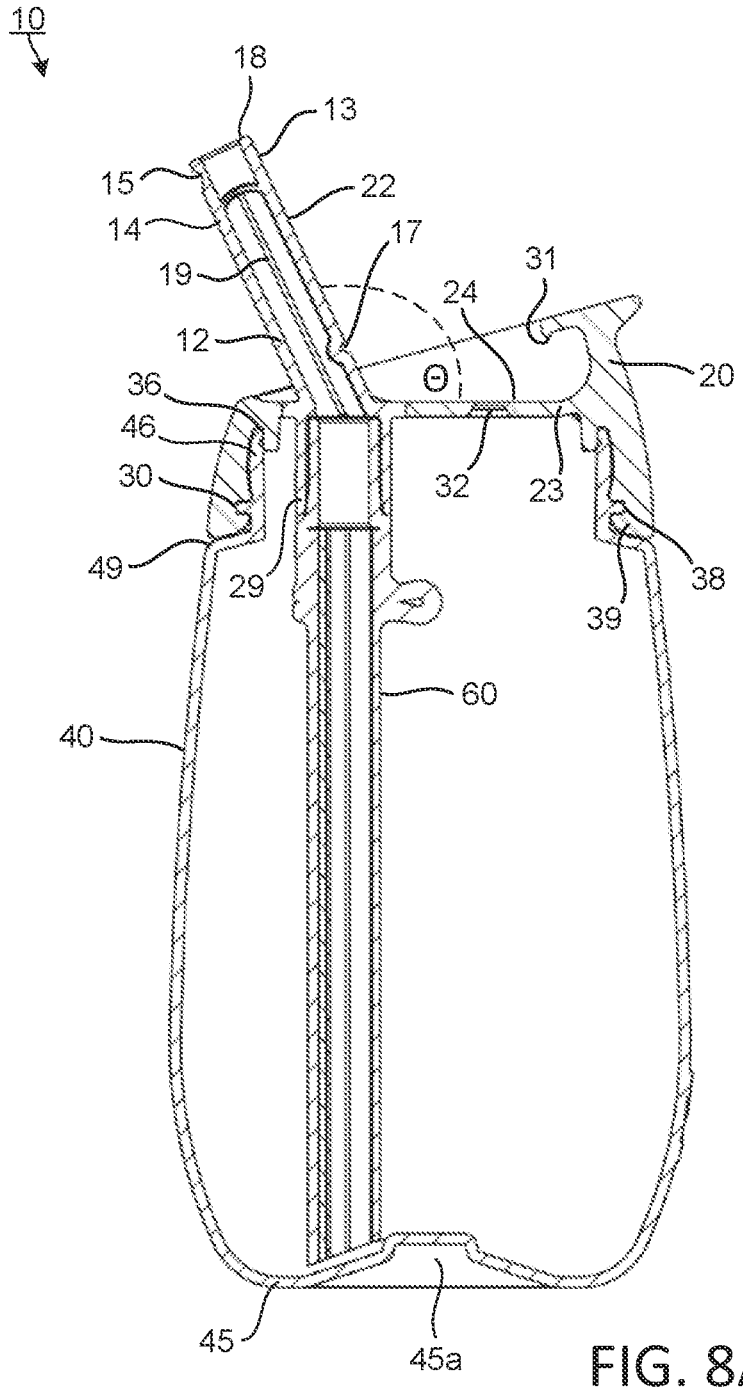
FIG. 8A is a side cross-sectional view of a cup assembly along plane A-A of FIG. 4, according to an exemplary embodiment of the present subject disclosure.
Figure 8B:
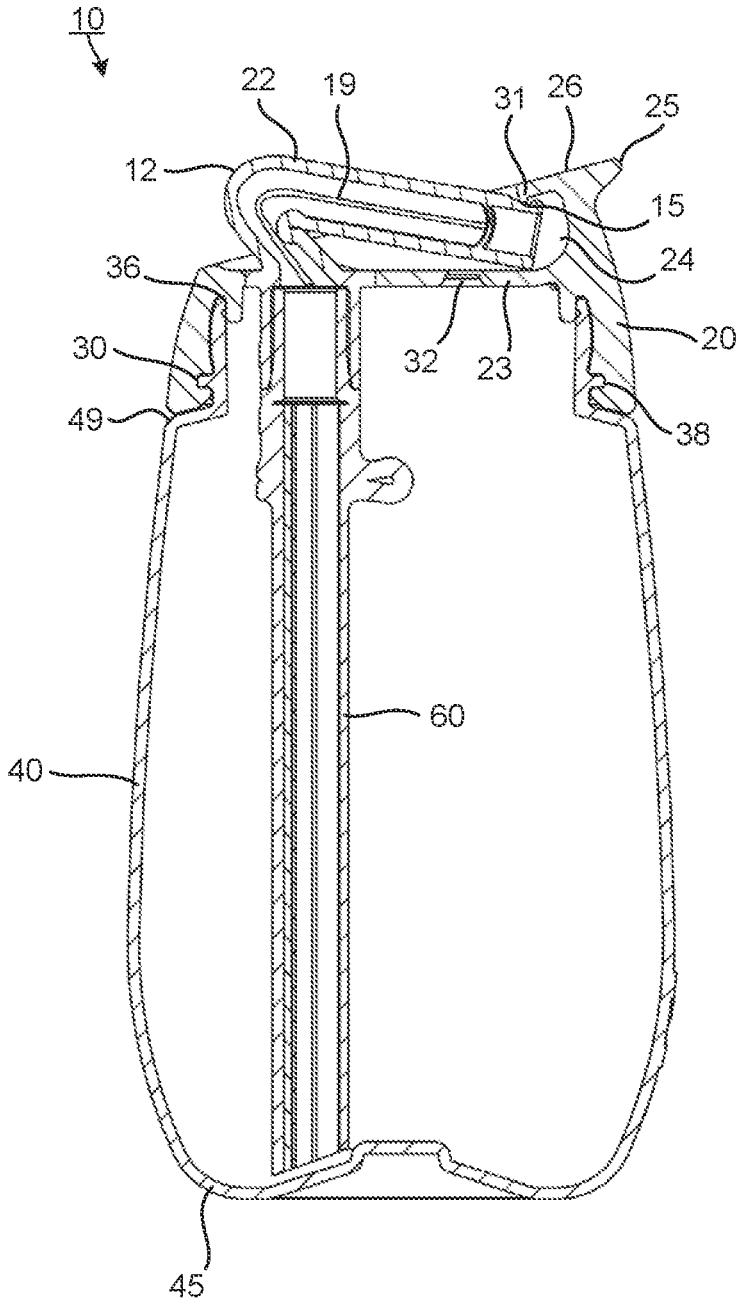
FIG. 8B is a side cross-sectional view of a cup assembly along plane B-B of FIG. 7B, according to an exemplary embodiment of the present subject disclosure.

FIG. 5 is a bottom view of the bottom 45 of the container body 40. The bottom 45 may be substantially planar or may have a convex or concave curvature relative to a resting surface. A series of concentric rings may be formed in the bottom 45 to enhance the grip and stability of the cup assembly 10 when resting on the surface. As shown in FIGS. 5 and 8A-B, the bottom 45 is substantially concave with a recessed center portion 45*a*. An air valve (not shown) may be disposed in the bottom 45 in order to facilitate pouring or the nursing or an infant with an appropriate lid attachment.

Figure 6:
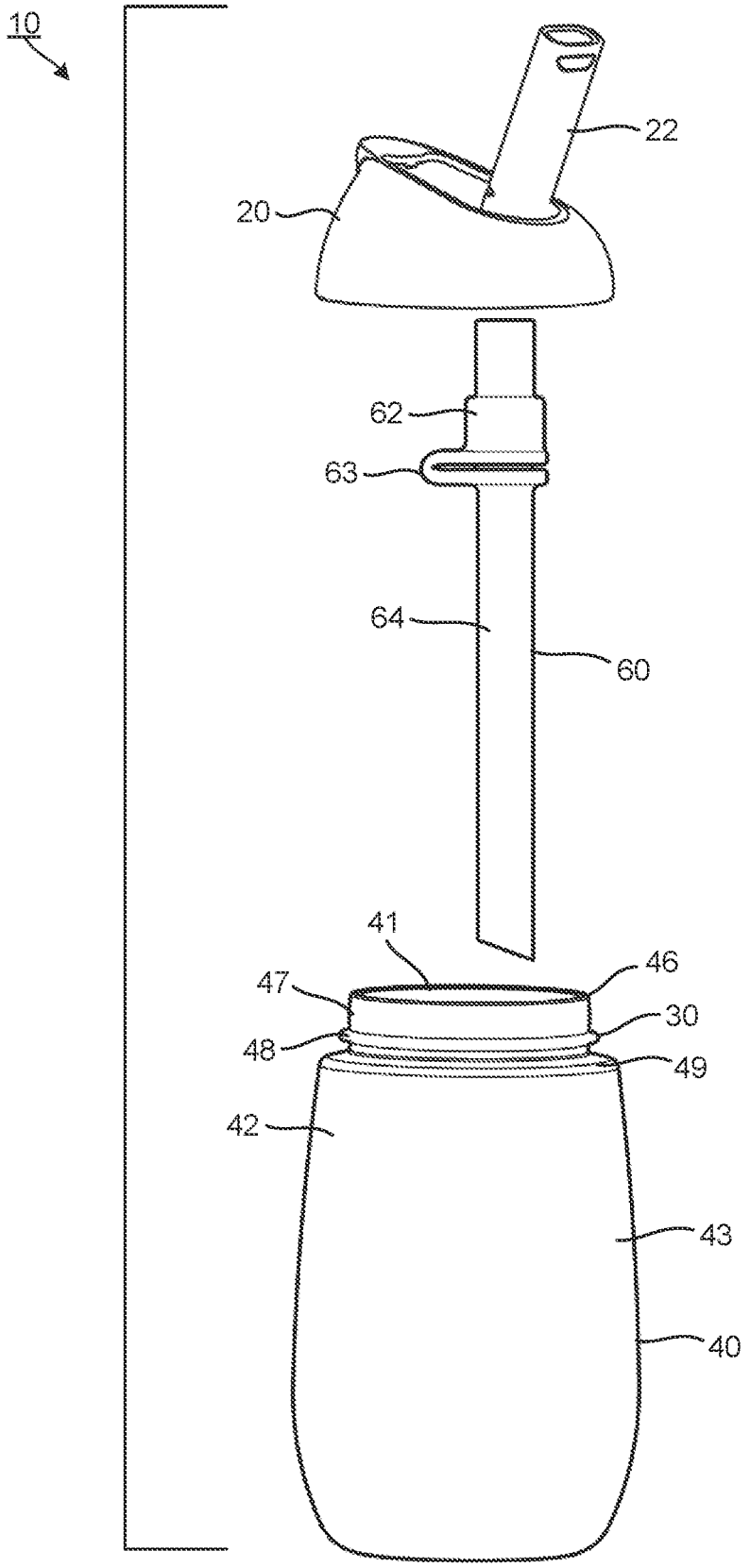
FIG. 6 is an exploded side perspective view of cup assembly, according to an exemplary embodiment of the present subject disclosure.

FIG. 6 is an exploded front perspective view of the cup assembly 10 showing the lid 20, container body 40 and straw assembly 60 in greater detail. As shown in FIG. 6, and FIGS. 7A-8B the lid 20 may attach to the container body 40 through the lid attachment 30. The lid attachment 30, including bottom lid attachment features 30*a* and container attachment features 30*b*, may be a complementary set of structural elements that secures the lid 20 to the container body 40 and prevents leaking, while also providing for an easy and efficient user experience. The container body 40 may include a lip 46 forming the uppermost rim of the container body 40 and extending annularly around a circumference of the upper portion 42. An upper sidewall 47 extends downward from the lip 46 and annularly around an opening 41. A lid attachment ridge 48 extends orthogonally from the upper sidewall 47, the upper sidewall 47 extending further downward and terminating at a junction with a shoulder 49. Additional lid attachment ridges 48 may be disposed on the upper sidewall 47. The lid attachment ridge 48 may have a predetermined width and a height. The width and height of the lid attachment ridge 48 may be consistent around the circumference of the upper portion 42, or the width and height may vary along its annular path about the upper portion 42. The width of the lid attachment ridge 48 may vary along the height such that a top portion of the lid attachment ridge 48 may be thicker or thinner than a lower portion. The shoulder 49 extends radially outward and way from the upper sidewall 47, and then curves downward along the outer surface 43 of the container body 40.

As shown in FIG. 8A, which is a cross-section of the cup assembly 10 along plane A-A of FIG. 4, and FIG. 8B, which is a cross-section of the cup assembly 10 along plane B-B of FIG. 7B, the bottom lid attachment features 30*a* disposed on the lid 20 mates with the complementary container attachment features 30*b* on the container body 40 in order to secure the lid 20 to the container body 40 through a leak-proof friction fit. The lid 20 may include a lip recess 36 disposed on the bottom surface 23 of the lid 20 to receive the lip 46. A ridge recess 38 may also be disposed on the bottom surface 23 of the lid 20 to receive the lid attachment ridge 48. More than one ridge recess 38 may be disposed on the bottom surface 23 in order to accommodate the inclusion of multiple lid attachment ridges 48. The ridge recess 38 may be shaped to accommodate and secure the lid attachment ridge 48 in a keyed fit.

A lid abutment 39 may be disposed at the lower end of the lid 20 and may extend around the lower circumference of the lid 20. A portion of the lid abutment 39 may rest upon the shoulder 49 of the container body 40 when the lid 20 is attached to the container body 40. The lid attachment features 30*a*, 30*b* ensure the leak-proof friction fit of the lid 20 to the container body 40, while also providing for easy disassembling and cleaning of the cup assembly 10. One of ordinary skill in the art would recognize that other attachment mechanisms may be used to secure the lid 20 to the container body 40 including screw fit, snap fit, tongue and groove, locking tabs, locking collar, magnetic attachment, and the like, which may be substituted without departing from the broader aspects of the present subject disclosure.

FIG. 6 shows the straw assembly 60 detached from the lid 20 and removed from the container body 40. The straw assembly 60 includes a cap 62 that is attached to a straw body 64 by a hinge 63. The cap 62 fits within a straw receiving aperture 29 disposed on the bottom surface 23 of the lid 20 (see also FIGS. 8A and 11). The straw receiving aperture 29 provides a direct conduit from the straw assembly 60 to a fluid channel 19 disposed in the flip straw 22 (FIG. 8A). When a user desires to draw a fluid from inside the cup assembly 10 thereout, a suction pressure is applied to a spout 18 disposed at a top portion 14 of the flip straw 22. This causes the fluid to enter the bottom of the straw assembly 60 and rise up through the straw body 64 and cap 62, past the straw receiving aperture 29 and into the fluid channel 19 on its way out of the flip straw 22 and into the mouth of the user.

The straw assembly 60 may be formed of a resilient and/or a flexible material having at least a first durometer. The straw assembly 60 may include a second and/or additional materials having at least a second durometer. For example, the cap 62 may be formed of the first material having the first durometer, while the straw body 64 may be formed of the second material having the second durometer. The first durometer may be harder than the second durometer, or this configuration may be reversed.

FIG. 7 shows a dose-up view of the lid 20 with the flip straw 22 in the open and extended position. The flip straw 22 may be formed of a resilient and/or a flexible material having at least a first durometer. The flip straw 22 may include a second and/or additional materials having at least a second durometer. For example, the spout 18 may be formed of the first material having the first durometer, while the top portion 14 or a bottom portion 16 of the flip straw 22 may be formed of the second material having the second durometer. The first durometer may be harder than the second durometer, or this configuration may be reversed.

As shown in FIGS. 7-10, the flip straw 22 is integrally formed within the lid 20 and biased towards the open and extended position. When the user desires to store the cup assembly 10 for travel or later use, the flip straw 22 may be pushed down into the recess 24 where it will be locked and prevented from extending by the flip lock 26. When the user desires to drink from the cup assembly 10 again, the trigger 25 may be actuated in order to release the flip straw 22 from the flip lock 26 and the recess 24. The flip straw 22 and flip lock 26 may be adapted for single-handed use. An adult or child user may be able to secure or release the flip straw 22 with a single hand. This is especially useful for an adult user that may be carrying another item in their other hand. When the flip straw 22 is secured in the recess 24, the cup assembly 10 may be designed to be leak-proof, such that liquid will not escape from the lid 20 or flip straw 22 when it is in the dosed position.

As shown in FIG. 8A-B, the flip lock 26 may have a hook end 31 that engages a ledge 15 or indentation disposed on a front side 12 of the flip straw 22. A rear side 13 of the flip straw 22 may include a notch 17 that is reinforced to facilitate the repeated bending of the flip straw 22. The notch 17 allows the flip straw 22 to crease and fold into a bent position for storage within the recess 24 without cracking or damaging the flip straw 22. The notch 17 may have a reduced thickness or increased thickness compared to the rest of the flip straw 22.

FIGS. 9-10 further detail the use of flip straw 22. FIG. 9 shows a user pushing the flip straw 22 into the recess 24 for storage. The opening and closing of the flip straw 22 may be accomplished with a single hand. The hook end 31 of the flip lock 26 catches and holds the ledge 15 of the flip straw 22. A click or other audible sound may indicate that the flip straw 22 is locked within the flip lock 26. When locked, the hook end 31 is locked into the ledge 15 on the flip straw 22. The sides of the flip straw 22 may engage left sidewall 27 and right sidewall 28 in the recess 24. When the user desires to use the flip straw 22 again, the trigger 25 is actuated by the user and the flip straw 22 springs out from within the recess 24. The trigger 25 is actuated by a downward force applied by the user to the trigger 25, which stretches the hook end 31 of the flip lock 26 out of the ledge 15 and thereby releases the flip straw 22 from the captivated, locked position. The trigger 25 may alternatively be a button that is disposed on the flip lock 26 or the lid 20.

The flip straw 22 may be biased to maintain a given interior angle (Θ) in the extended position relative to the bottom of the recess 24. The angle may be an interior angle (Θ) measured between the plane defined by the rear side 13 of the flip straw 22 and the plane defined by the bottom surface of the recess 24 and may be substantially between 30-180 degrees (see FIG. 8A). The angle may be between 75-145 degrees. The angle may be approximately 120 degrees. The flip straw 22 may bend beyond angle Θ until the front side 12 of the flip straw 22 touches the upper surface 21 of the lid 20, but the flip straw 22 will return to its resting configuration when an external force caused by the user or other environmental condition is removed. The flip straw 22 may include a bite-proof portion (not shown) having a different thickness or tougher durometer relative to the rest of the straw assembly 60 in order to protect from the bite of a user.

FIG. 11 shows the bottom surface 23 of the lid 20 with the straw assembly 60 removed from the straw receiving aperture 29. An air valve 32 may be disposed in the lid 20. The air valve 32 may be disposed through the bottom of the recess 24 and may extend through to the bottom surface 23 of the lid 20 (FIG. 8A). The air valve 32 helps to prevent a vacuum pressure from forming inside the cup assembly 10 when a user is drinking by allowing air to escape from within the container body 40. The air valve 32 may be disposed at any location on the lid 20 or container body 40.

Figure 12:
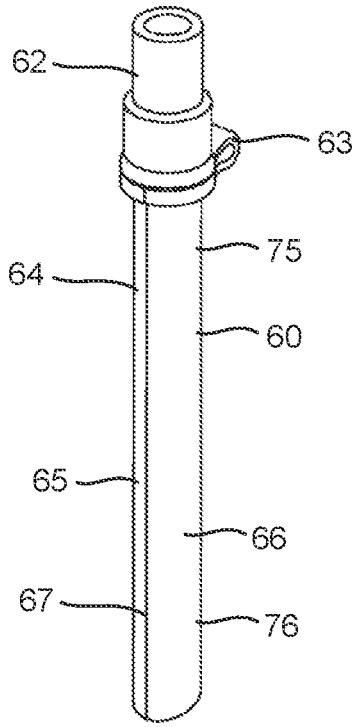
FIG. 12 is a front perspective view of a straw, according to an exemplary embodiment of the present subject disclosure.
Figure 13:
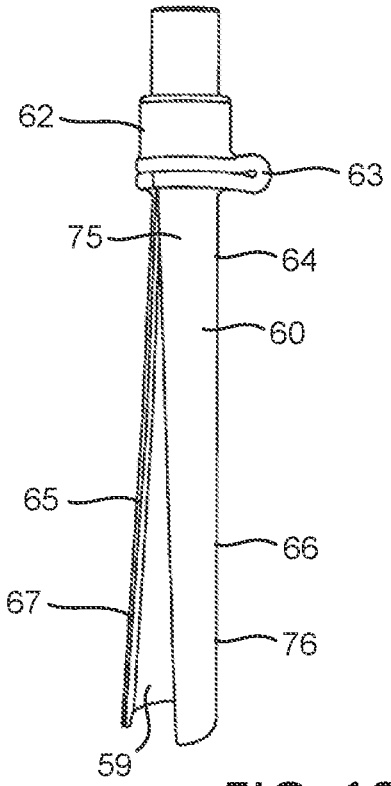
FIG. 13 is a side perspective view of a straw, according to an exemplary embodiment of the present subject disclosure.
Figure 14:
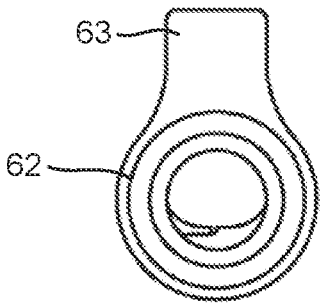
FIG. 14 is a top view of a straw, according to an exemplary embodiment of the present subject disclosure.

FIGS. 12-228 show the straw assembly 60 in greater detail. As shown in FIGS. 12-13, the straw assembly 60 has the straw body 64 with the cap 62. The straw body 64 has a top end 75 and a bottom end 76 with a seam 67 running along the longitudinal length of the straw body 64. The seam 67 joins a left end 65 of a first side and a right end 66 of a second side of the straw body 64 together. When the left and right ends 65, 66 are joined together in a closed position, the straw assembly 60 is a cylinder capable of transmitting a suction force and thereafter the fluid from inside the cup assembly 10 thereout. When the left and right ends 65, 66 are broken apart, the straw body 64 may be flattened out in an open position in order to clean an interior surface 59 of the straw assembly 60. The cap 62 fits over the straw body 64 when the left and right ends 65, 66 are joined together to prevent the straw body 64 from opening during use. The cap 62 joins the straw assembly 60 to the lid 20 through its complementary fit within the straw receiving aperture 29. The cap 62 may be joined to the straw body 64 by the hinge 63. A top view of the straw assembly 60 is shown in FIG. 14.

Figure 15:
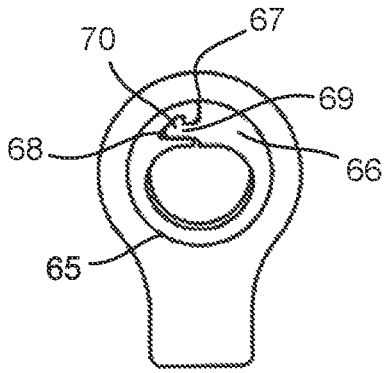
FIG. 15 is a bottom view of a straw, according to an exemplary embodiment of the present subject disclosure.

FIG. 15 is a bottom view of the straw assembly 60 showing the seam 67 in greater detail. The seam 67 is formed by a rib 69 that is received within a groove 68 (see also FIG. 19). The rib 69 and groove 68 extend along the longitudinal length of the left and right ends 65, 66 of the straw body 64. As shown in FIG. 15, the rib 69 is disposed on the right end 66 and the groove 68 is disposed on the left end 65, but this configuration may be reversed without altering the function of the straw assembly 60. The rib 69 may lock within the groove 68 through a friction fit, The rib 69 may be shaped to lock within the groove 68 through a keyed fit. A tip 70 may extend along the length of the rib 69 and may have a hook shape in order to securely lock within the groove 68. The right end 66 having the rib 69 may be adapted to extend over and above the left end 65 having the groove 68 (not shown). The overlapping rib 69 may then be pressed down and into the groove 68 in order to seal the seam 67 in the closed position. Additionally, the rib 69 and groove 68 may be patterned with complementary raised portions and recessed portions (not shown) that match up and lock together when the seam 67 is sealed. Various complementary geometries between the rib 69 and the groove 68 may accomplish the stated function of securely joining the seam 67 closed together and are within the scope of this subject disclosure.

Figure 16:
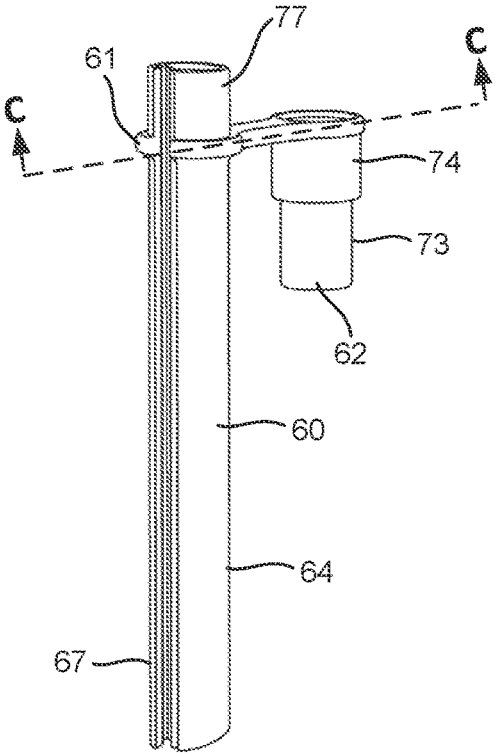
FIG. 16 is a front perspective of a straw, according to an exemplary embodiment of the present subject disclosure.
Figure 18:
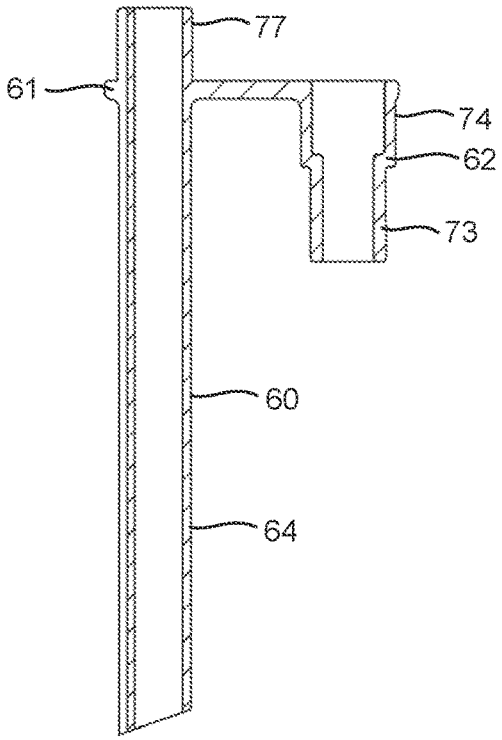
FIG. 18 is a side cross-sectional view of a straw along plane D-D of FIG. 17, according to an exemplary embodiment of the present subject disclosure.

FIG. 16 is a front perspective view of the straw assembly 60 with the seam 67 open and the cap 62 removed from the straw body 64. The cap 62 may include an upper section 73 and a lower section 74. The upper section 73 may be substantially cylindrical and may have a first diameter. The lower section 74 may be substantially cylindrical and may have a second diameter, As shown in FIGS. 12-13, 16 and 18 the first diameter is smaller than the second diameter. However, this configuration may be reversed, or the diameter of the upper and lower sections 73, 74 may be substantially equal, without departing from departing from the broader aspects of the present subject disclosure.

The upper section 73 of the cap 62 may be adapted to fit within the straw receiving aperture 29 of the lid 20 (see also FIGS. 8A and 11). The larger diameter of the lower section 74 may act as a stop that limits the insertion of the cap 62 into the straw receiving aperture 29, as the straw receiving aperture 29 may be sized only to receive the first diameter of the upper section 73. The second diameter of the lower section 74 of the cap 62 may be sized to fit snugly over a neck portion 77 disposed at the top end 75 of the straw body 64. The bottom of the neck portion 77 may be delimited by a flange 61 disposed on the straw body 64. The flange 61 may be an extension of the hinge 63 that connects the cap 62 to the straw body 64 while strengthening the hinge connection. The flange 61 may also serve as a bottom stop for limiting the distance that the lower section 74 of the cap 62 may fit over the neck portion 77. The smaller diameter of the upper section 73 may also limit how deeply the cap 62 may travel down the neck portion 77 of the straw body 64.

Figure 17:
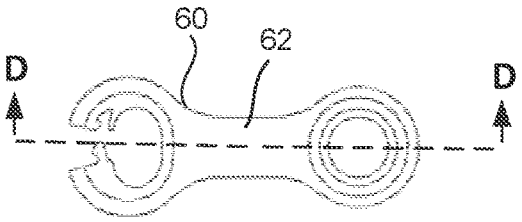
FIG. 17 is a top view of a straw, according to an exemplary embodiment of the present subject disclosure.
Figure 19:
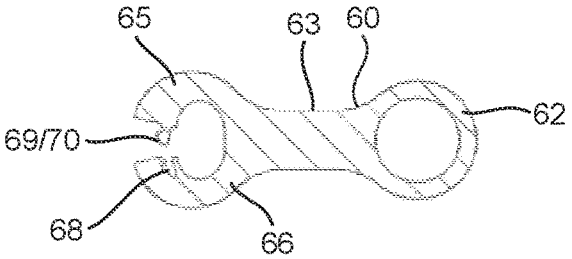
FIG. 19 is a top cross-sectional view of a straw along plane C-C of FIG. 16, according to an exemplary embodiment of the present subject disclosure.

FIG. 17 is a top view of the straw assembly 60 of FIG. 16. FIG, 18 is a side cross-sectional view of the straw assembly 60 along plane D-D of FIG. 17, while FIG. 19 is a top cross-sectional view of the straw assembly 60 along plane C-C of FIG. 16. As discussed above, the cap 62 is attached to the straw body 64 by the hinge 63. The flange 61 may be an extension of the hinge 63 around the diameter of the straw body 64. As shown in FIGS. 16-19, the seam 67 extends along the longitudinal length of the straw body 64, while the cap 62 is an integral piece with no seam 67 that is adapted to fit over the straw body 64 and secures the straw assembly 60 in a closed position. In FIG. 19, the rib 69 is disposed on the left end 65, while the groove 68 is disposed on the right end 66. It is also contemplated that the seam 67 may extend into the cap 62 (not shown) so that the entire straw assembly 60 may be opened for cleaning.

Figure 20A:
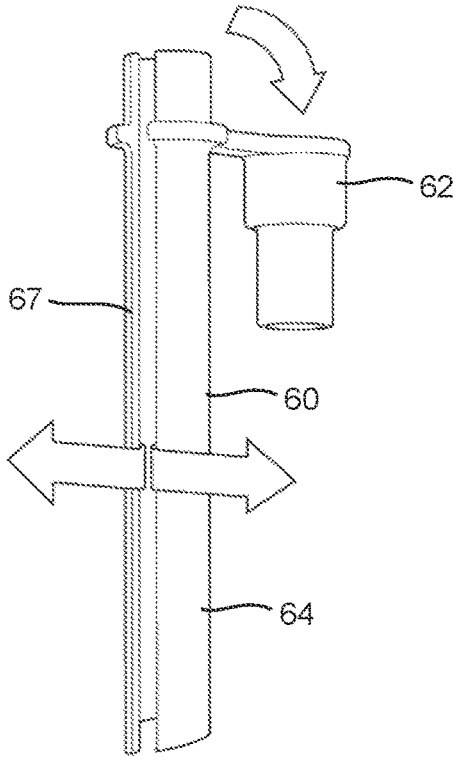
FIG. 20A is a front perspective view of a straw in use, according to an exemplary embodiment of the present subject disclosure.
Figure 20B:
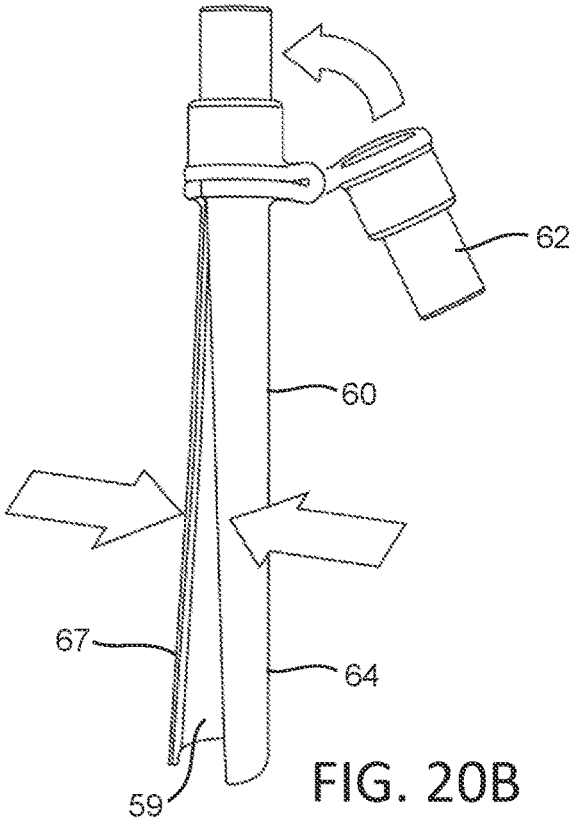
FIG. 20B is a front perspective view of a straw in use, according to an exemplary embodiment of the present subject disclosure.
Figure 20C:
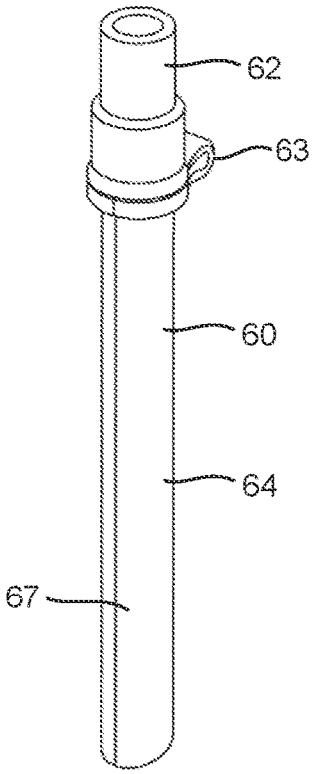
FIG. 20C is a front perspective view of a straw, according to an exemplary embodiment of the present subject disclosure.

FIGS. 20A-20C show the straw assembly 60 in preparation for use (FIG. 20B) and cleaning (FIG. 20A). As shown in FIG. 20A, when the user desires to clean the straw assembly 60, the cap 62 is removed from the straw body 64 and the seam 67 is opened. This allows the user to clean the interior surface 59 of the straw body 64 conveniently and thoroughly. As shown in FIG. 20B, when the user desires to use the straw assembly 60, the seam 67 is closed and the cap 62 is pivoted about the hinge 63 and attached to the straw body 64. FIG. 20C shows the straw assembly 60 in the closed use position.

Figure 21A:
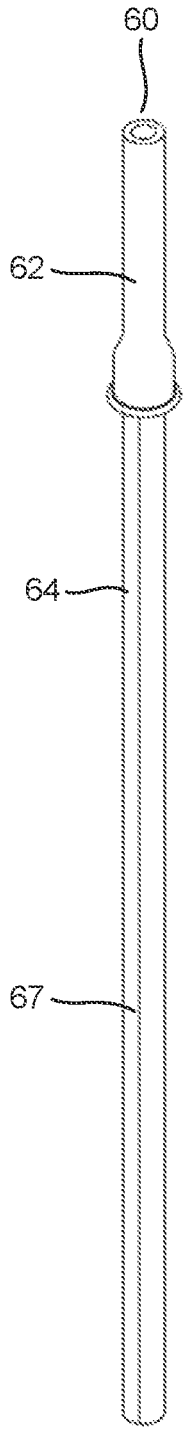
FIG. 21A is a front perspective view of a straw, according to an exemplary embodiment of the present subject disclosure.
Figure 21B:
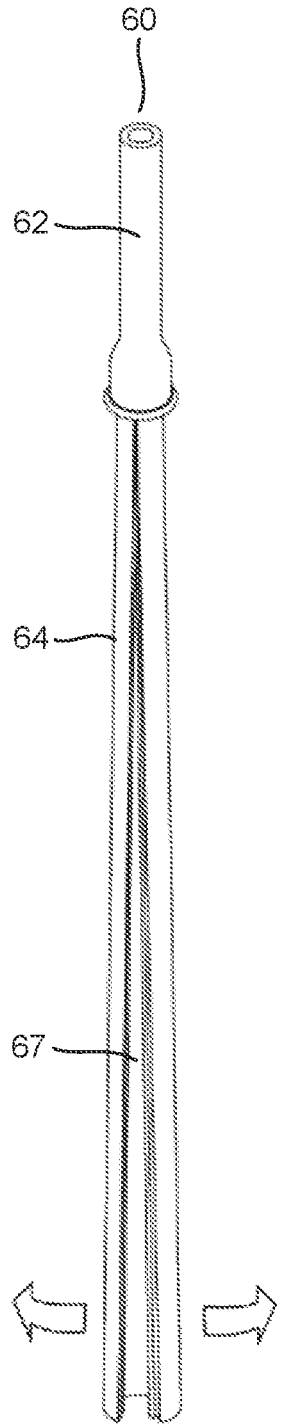
FIG. 21B is a front perspective view of a straw, according to an exemplary embodiment of the present subject disclosure.

FIGS. 21A-24B show alternate embodiments of the straw assembly 60. As shown in FIGS. 21A-B, the straw assembly 60 may include the straw body 64 with the seam 67 extending the length of the straw body 64. The cap 62 may have an elongated shape and may be removably attached to the straw body 64 without the hinge 63.

As shown in FIGS, 22A-C, the straw body 64 and the cap 62 may be integrally attached. An overmold portion 71 may be overmolded onto the integral straw body 64 and the 62. The straw body 64 and cap 62 may be formed of a first material having a first material property, while the overmold portion 71 may be formed of the first material or a second material having a second material property. The overmold portion 71 may attach to the straw body 64 at an overmold junction 72 that defines the connection and border between the straw body 64 and the cap 62. The overmold portion 71 may lock the seam 67 in a closed position at the overmold junction 72. The overmold portion 71 may be integral with or removable from the cap 62. The seam 67 may extend into, or along the entire length of the cap 62.

Figure 22A:
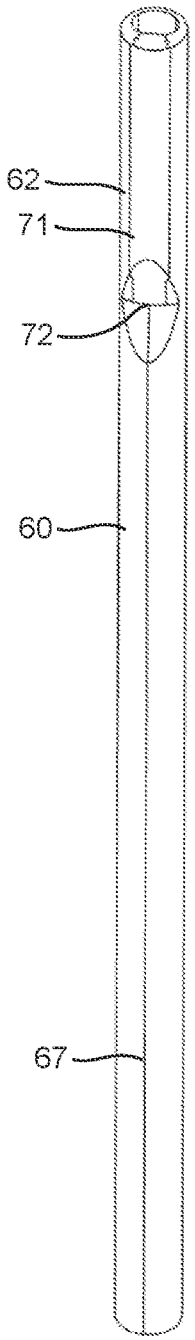
FIG. 22A is a front perspective view of a straw, according to an exemplary embodiment of the present subject disclosure.
Figure 22B:
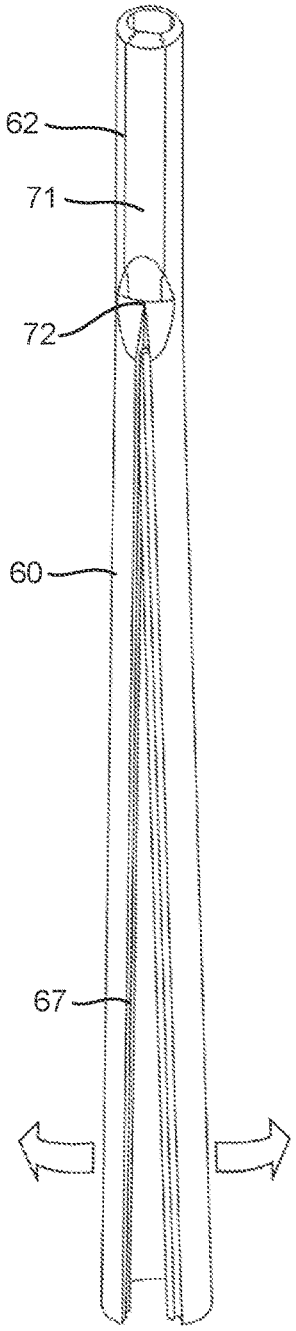
FIG. 22B is a front perspective view of a straw, according to an exemplary embodiment of the present subject disclosure.
Figure 22C:
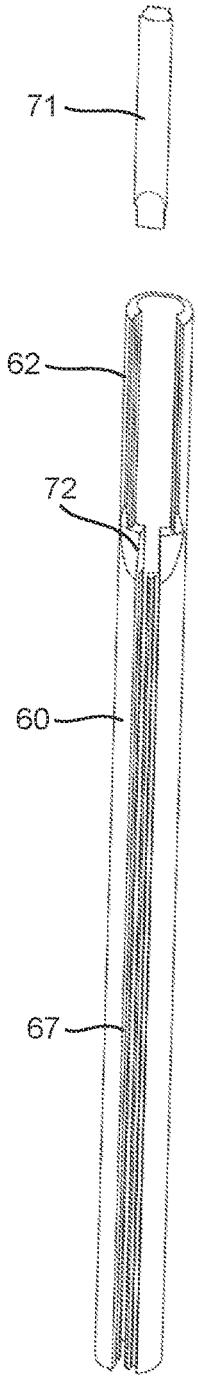
FIG. 22C is a front perspective view of a straw, according to an exemplary embodiment of the present subject disclosure.

As shown in FIG. 22B, the straw body 64 may be opened along the seam 67 to facilitate the efficient and convenient cleaning of the straw assembly 60. The straw body 64 and the cap 62 may be one integral piece without the overmold portion 71, or the cap 62 itself may be overmolded onto the straw body 64. The cap 62 or the straw body 64 may include a bite-proof portion (not shown) having a different thickness or tougher durometer relative to the rest of the straw assembly 60 in order to protect from the bite of a user.

Figure 23A:
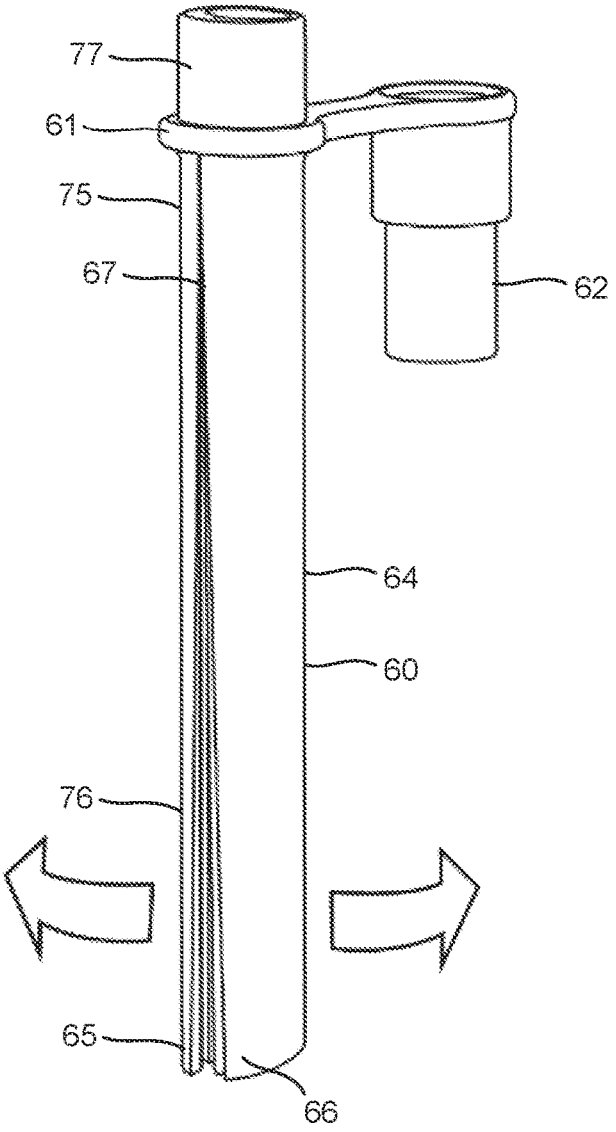
FIG. 23A is a front perspective view of a straw, according to an exemplary embodiment of the present subject disclosure.
Figure 23B:
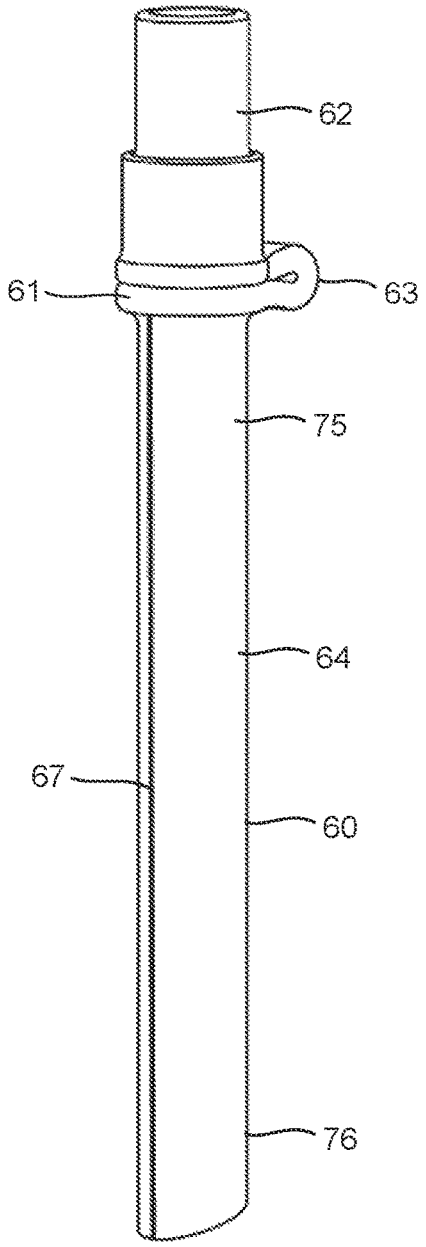
FIG. 23B is a front perspective view of a straw, according to an exemplary embodiment of the present subject disclosure.

As shown in FIGS. 23A-B, the seam 67 may extend only partially along the length of the straw body 64. As shown in FIG. 23A, the seam 67 ends at the flange 61 and does not extend into the neck portion 77. This may improve the stability of the seam 67 when closed and/or improve the fit of the cap 62 onto the neck portion 77 of the straw body 64, while still allowing for the opening of the straw body 64 for cleaning purposes. It is also contemplated that the seam 67 may be sealed at the bottom end 76 of the straw body 64, or that the seam 67 may be interrupted by a continuous portion of the straw body 64 at any point along its path extending from the bottom end 76 to the top end 75 of the straw body 64 (not shown). In such an interrupted configuration, the straw body 64 will only open partially. If, for example, a continuous portion of the straw body 64 interrupts the seam 67 at the middle of the straw body 64, then the seam 67 may be split at the top end 75 and at the bottom end 76 but will remained closed at the middle. It is also contemplated that the left and right ends 65, 66 of the straw body 64 may have a complementary geometry such as a zipper configuration, ratchet, alternating steps, matching teeth and the like, for sealing the seam 67 closed (not shown). In other words, the seam 67 may not be disposed substantially as a straight line up the longitudinal side of the straw body 64 but may zig and zag along the geometry of the complementary left and right ends 65, 66. The seam 67 may also extend diagonally along the straw body 64, or the seam 67 may spiral up and along the diameter of the straw body 64.

Figure 24A:
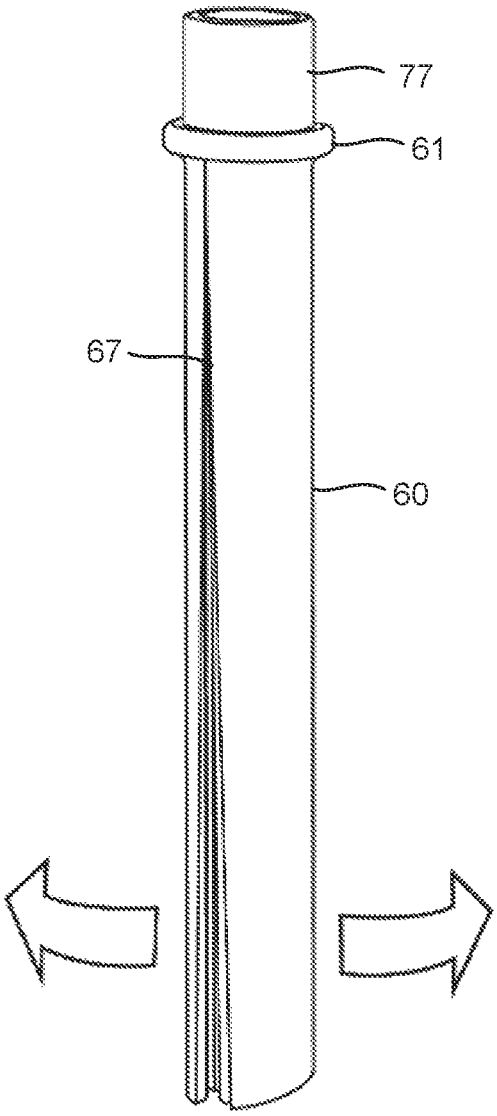
FIG. 24A is a front perspective view of a straw, according to an exemplary embodiment of the present subject disclosure.
Figure 24B:
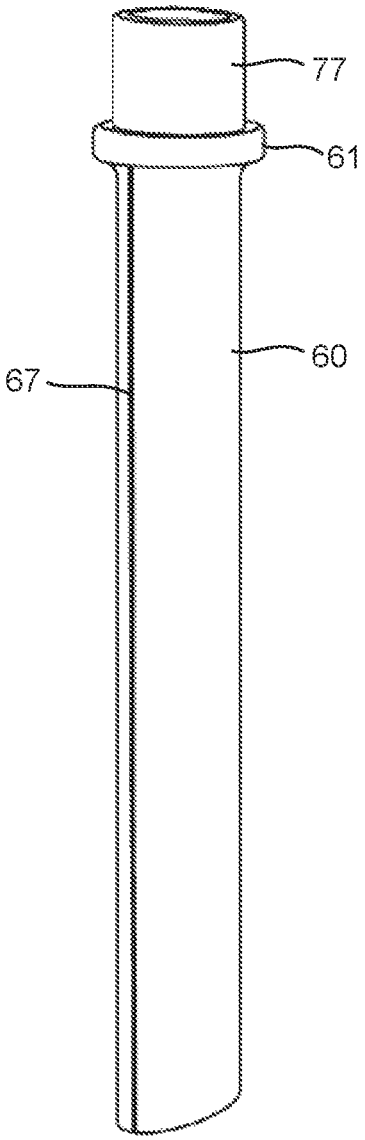
FIG. 24B is a front perspective view of a straw, according to an exemplary embodiment of the present subject disclosure.

FIGS. 24A-B show an embodiment of the straw assembly 60 without the cap 62 or the hinge 63. As shown in FIG. 24A, the seam 67 terminates at the flange 61 and does not extend into the neck portion 77. Consequently, the neck portion 77 is more stable when it is inserted into the straw receiving aperture 29 of the lid 20. The flange 61 in this configuration may act as a stop for inserting the straw assembly 60 into the straw receiving aperture 29. Alternatively, the straw body 64 may be disposed without the flange 61, and/or the seam 67 may extend along the entire length of the straw body 64 while still being adapted to be received securely into the straw receiving aperture 29 of the lid 20.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiments described herein, but is intended to cover all modifications and changes within the scope and spirit of the invention.

What is claimed:

1. A cup assembly comprising:
a container body;
a lid having a flip straw that is extendable; and
a straw assembly having a cap and a straw body which are connected by a hinge, the straw assembly adapted to connect to the lid and having a seam that runs along the length of the straw body in order to open the straw assembly for cleaning.

2. The cup assembly recited in claim 1, further comprising a recess on the lid for receiving the flip straw.

3. The cup assembly recited in claim 2, further comprising a flip lock disposed on the lid for retaining the flip straw in the recess in a locked position.

4. The cup assembly recited in claim 3, wherein the flip lock has a hooked end for engaging a ledge disposed on the flip straw.

5. The cup assembly recited in claim 4, wherein the flip lock has a trigger that is actuated to release the flip straw from the locked position to an extended position.

6. The cup assembly recited in claim 1, wherein the flip straw is resilient and biased towards an extended position.

7. The cup assembly recited in claim 1, further comprising an air valve disposed on the lid.

8. The cup assembly recited in claim 1, further comprising an aperture in the lid to receive the cap of the straw assembly.

9. The cup assembly recited in claim 1, wherein the straw body has a first end having a rib and a second end having a groove, the rib adapted to be received in the groove to seal the straw body in a closed position.

10. A cup assembly comprising:
a container body;
a lid having a resilient flip straw biased towards an extended position; and
a straw assembly comprising:
a straw body having an upper portion and a lower portion;
a cap attached to the upper portion by a hinge; and
a resealable seam for opening and dosing the straw body.

11. The cup assembly recited in claim 10, further comprising a recess on the lid for receiving the flip straw.

12. The cup assembly recited in claim 11, further comprising a flip lock disposed on the lid to retain the flip straw in the recess in a locked position.

13. The cup assembly recited in claim 12, wherein the flip lock has a trigger that is actuated to release the flip straw from the locked position to the extended position.

14. The cup assembly recited in claim 10, wherein the straw body has a first end having a rib and a second end having a groove, the rib adapted to be received in the groove to seal the straw body in a closed position.

15. A cup assembly comprising:
a container body;
a straw comprising:
a straw body having an upper portion and a lower portion;
a cap attached to the upper portion by a hinge; and
a seam extending from the lower portion to the upper portion; and a lid comprising:
an extendable flip straw;
a recess;
a flip lock that secures the flip straw in the recess; and
a trigger that is actuated to release the flip straw from the flip lock.

16. The cup assembly recited in claim 15, wherein the straw body has a first end having a rib and a second end having a groove, the rib adapted to be received in the groove to seal the straw body in a closed position.

17. The cup assembly recited in claim 15, wherein the flip lock has a hooked end for engaging a ledge disposed on the flip straw.

18. The cup assembly recited in claim 15, further comprising an aperture in the lid for receiving the cap of the straw assembly.

* * * * *